US008390555B2

(12) United States Patent
Huang

(10) Patent No.: US 8,390,555 B2
(45) Date of Patent: Mar. 5, 2013

(54) LIQUID CRYSTAL DISPLAY CAPABLE OF COMPENSATING COMMON VOLTAGE SIGNAL THEREOF

(75) Inventor: Shun-Ming Huang, Shenzhen (CN)

(73) Assignees: Innocom Technology (Shenzhen) Co., Ltd., Sehnzhen, Guangdong Province (CN); Chimei Innolux Corporation, Miaoli County (TW)

( * ) Notice: Subject to any disclaimer, the term of this patent is extended or adjusted under 35 U.S.C. 154(b) by 857 days.

(21) Appl. No.: 12/154,839

(22) Filed: May 27, 2008

(65) Prior Publication Data

US 2009/0002303 A1 Jan. 1, 2009

(30) Foreign Application Priority Data

May 25, 2007 (CN) ..... 2007 1 0074604

(51) Int. Cl.
*G09G 3/36* (2006.01)

(52) U.S. Cl. ..... 345/98; 345/95

(58) Field of Classification Search ..... 345/3.3, 345/55, 58, 61, 67, 83–105, 204–206, 210, 345/212, 690

See application file for complete search history.

(56) References Cited

U.S. PATENT DOCUMENTS 5,646,643 A * 7/1997 Hirai et al. ..... 345/100
5,831,605 A * 11/1998 Yasui et al. ..... 345/211
6,020,870 A * 2/2000 Takahashi et al. ..... 345/92
6,359,607 B1 * 3/2002 Yanagi et al. ..... 345/94
6,963,335 B2 * 11/2005 Tanaka et al. ..... 345/204
7,876,303 B2 * 1/2011 Moon et al. ..... 345/100
2006/0244704 A1 * 11/2006 JaeHun ..... 345/92
2007/0002005 A1 * 1/2007 Kim et al. ..... 345/103
2007/0024560 A1 * 2/2007 Kim et al. ..... 345/94
2007/0024565 A1 * 2/2007 Choi ..... 345/98
2007/0164952 A1 * 7/2007 Kim ..... 345/87

FOREIGN PATENT DOCUMENTS

CN 1908741 A 2/2007

* cited by examiner

*Primary Examiner* — Chanh Nguyen
*Assistant Examiner* — James Nokham
(74) *Attorney, Agent, or Firm* — Muncy, Geissler, Olds & Lowe, PLLC

(57) ABSTRACT

An exemplary liquid crystal display includes a liquid crystal panel having a plurality of pixel units arranged in rows, a scanning circuit configured to activate the pixel units row by row by outputting a plurality of corresponding scanning signals, a data circuit configured to provide data voltage signals to the activated pixel units, and a common voltage circuit. Each pixel unit includes a coupling member. When a row of pixel units is activated, all the coupling members in the row of pixel units cooperatively generate a coupling signal according to the data voltage signals applied to the activated row of pixel units, and superpose the coupling signal to the corresponding scanning signal so as to form a feedback signal. The common voltage circuit adjusts a reference voltage signal according to the feedback signal, and provides at least one common voltage signal to the pixel units.

20 Claims, 3 Drawing Sheets

LIQUID CRYSTAL DISPLAY CAPABLE OF COMPENSATING COMMON VOLTAGE SIGNAL THEREOF

CROSS-REFERENCE TO RELATED APPLICATION

This application is related to, and claims the benefit of, a foreign priority application filed in China as Ser. No. 200710074604.0 on May 25, 2007. The related application is incorporated herein by reference.

FIELD OF THE INVENTION

The present invention relates to liquid crystal displays (LCDs), and more particularly to an LCD capable of compensating a common voltage signal thereof.

GENERAL BACKGROUND

LCDs are widely used in various information products, such as notebooks, personal digital assistants, video cameras, and the like.

FIG. 3 is an abbreviated circuit diagram of a conventional LCD. The LCD 100 includes a liquid crystal panel 101, a scanning circuit 102, and a data circuit 103. The liquid crystal panel 101 includes n rows of parallel scanning lines 110 (where n is a natural number), m columns of parallel data lines 120 perpendicular to the scanning lines 110 (where m is also a natural number), and a plurality of pixel units 140 cooperatively defined by the crossing scanning lines 110 and data lines 120. The scanning lines 110 are connected to the scanning circuit 102, and the data lines 120 are connected to the data circuit 130.

Each pixel unit 140 includes a thin film transistor (TFT) 141, a pixel electrode 142, and a common electrode 143. A gate electrode of the TFT 141 is connected to a corresponding one of the scanning lines 110, and a source electrode of the TFT 141 is connected to a corresponding one of the data lines 120. Further, a drain electrode of the TFT 141 is connected to the pixel electrode 142. The common electrodes 143 of all the pixel units 140 are connected together and further connected to a common voltage generating circuit (not shown). In each pixel unit 140, liquid crystal molecules (not shown) are disposed between the pixel electrode 142 and the common electrode 143, so as to cooperatively form a liquid crystal capacitor 147.

In operation, the common electrodes 143 receive a common voltage signal from the common voltage generating circuit. The scanning circuit 102 provides a plurality of scanning signals to the scanning lines 110 sequentially, so as to activate the pixel units 140 row by row. The data circuit 103 provides a plurality of data voltage signals to the pixel electrodes 142 of the activated pixel units 140. Thereby, the liquid crystal capacitors 147 of the activated pixel units 140 are charged. After the charging process, an electric field is generated between the pixel electrode 142 and the common electrode 143 in each pixel unit 140. The electric field drives the liquid crystal molecules to control light transmission of the pixel unit 140, such that the pixel unit 140 displays a particular color (red, green, or blue) having a corresponding gray level. The electric field is maintained by the liquid crystal capacitor 147 during a so-called current frame period, and accordingly the gray level of the color is maintained during the current frame period.

In the LCD 100, each pixel unit 140 employs a capacitor structure (i.e. the liquid crystal capacitor 147) to maintain the gray level of the color. In addition, a plurality of parasitic capacitors usually exist in the pixel unit 140. Due to a so-called capacitor coupling effect, when the data voltage signal received by the pixel electrode 142 changes, an electrical potential of the common electrode 143 may be coupled and shift from the common voltage signal.

The shift of the electrical potential of the common electrode 143 may further bring on a change of the electric field between the pixel electrode 142 and the common electrode 143. Thereby, the gray level of the color displayed by the pixel unit 140 is apt to change, and accordingly a so-called color shift phenomenon may be generated. Thus the display quality of the LCD 100 may be somewhat unsatisfactory.

What is needed is to provide an LCD that can overcome the above-described deficiencies.

SUMMARY

In a first aspect, a liquid crystal display includes a liquid crystal panel having a plurality of pixel units arranged in rows, a scanning circuit configured to activate the pixel units row by row by outputting a plurality of corresponding scanning signals, a data circuit configured to provide data voltage signals to the activated pixel units, and a common voltage circuit. Each pixel unit includes a coupling member. When a row of pixel units is activated, all the coupling members in the row of pixel units cooperatively generate a coupling signal according to the data voltage signals applied to the activated row of pixel units, and superpose the coupling signal to the corresponding scanning signal so as to form a feedback signal. The common voltage circuit adjusts a reference voltage signal according to the feedback signal, and provides at least one common voltage signal to the pixel units.

In a second aspect, a liquid crystal display includes a plurality of pixel units arranged in rows and cooperatively defined by a plurality of scanning lines and a plurality of data lines, a scanning circuit configured to activate the pixel units row by row via the scanning lines, a data circuit configured to provide data voltage signals to an activated row of the pixel units via the data lines, and a common voltage circuit. Each pixel unit comprises a pixel electrode, a common electrode, and a coupling member, the coupling members transfer electrical potential shifts of the common electrodes to a corresponding one of the scanning lines when the data voltage signals are applied to the pixel electrodes of the activated row of pixel units, and the common voltage circuit generates at least one common voltage signal according to a feedback signal obtained from the corresponding scanning line.

Other novel features and advantages will become more apparent from the following detailed description when taken in conjunction with the accompanying drawings.

DETAILED DESCRIPTION OF PREFERRED EMBODIMENTS

Reference will now be made to the drawings to describe preferred and exemplary embodiments of the present invention in detail.

Figure 1:
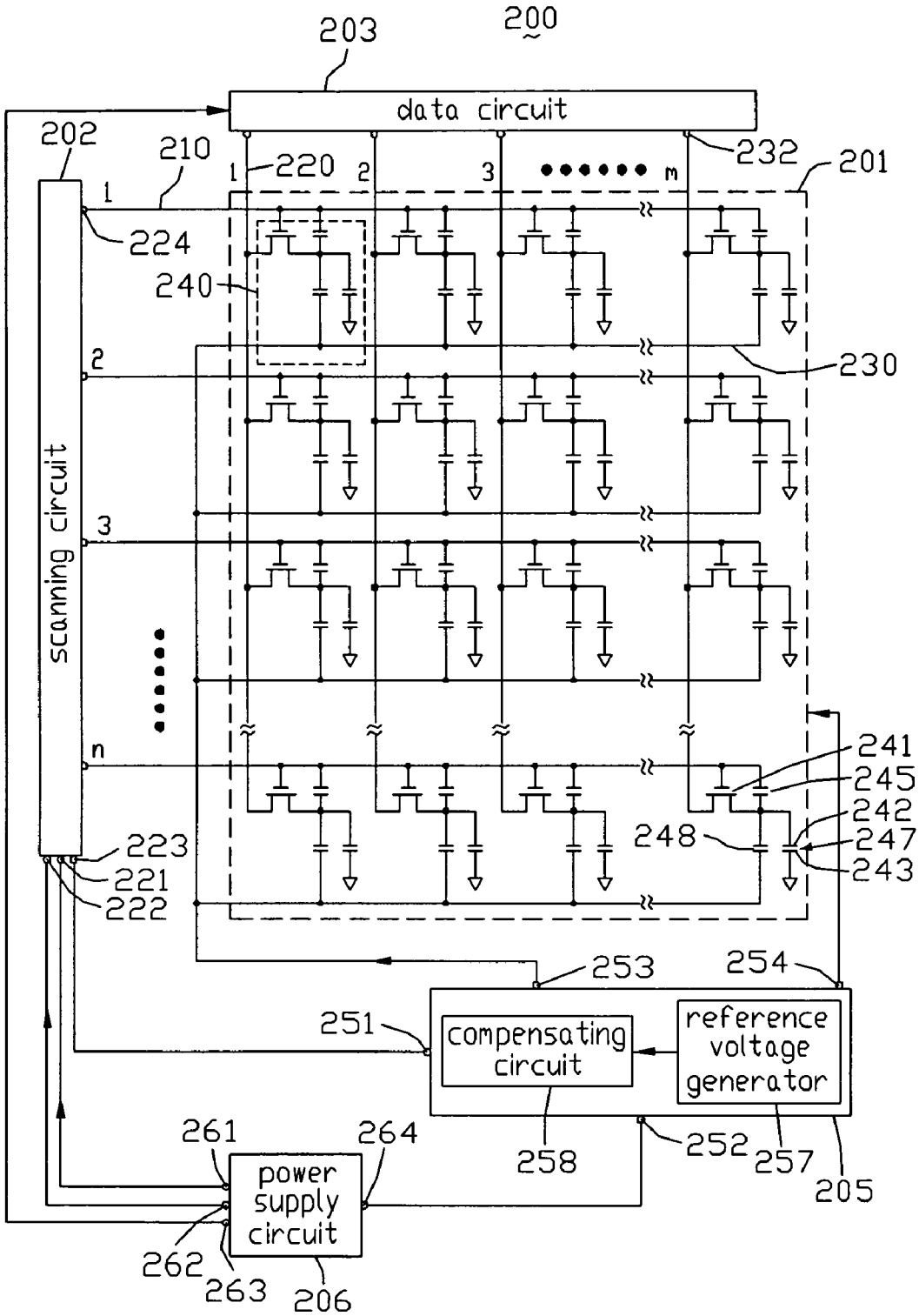
FIG. 1 is an abbreviated circuit diagram of an LCD according to an exemplary embodiment of the present invention, the LCD including a compensating circuit therein.

FIG. 1 is an abbreviated circuit diagram of an LCD according to an exemplary embodiment of the present invention. The LCD 200 includes a liquid crystal panel 201, a scanning circuit 202, a data circuit 203, a common voltage circuit 205, and a power supply circuit 206.

The liquid crystal panel 201 includes n rows of parallel scanning lines 210 (where n is a natural number), n rows of parallel common lines 230 alternately arranged with the scanning lines 210, m columns of parallel data lines 220 perpendicular to the scanning lines 210 and the common lines 230 (where m is also a natural number), and a plurality of pixel units 240 cooperatively defined by the crossing scanning lines 210 and data lines 220. Thus, the pixel units 240 are arranged in a matrix having n rows and m columns.

Each pixel unit 240 includes a TFT 241, a pixel electrode 242, a common electrode 243, a storage capacitor 248, and a coupling capacitor 245. A gate electrode of the TFT 241 is connected to a corresponding one of the scanning lines 210, and a source electrode of the TFT 241 is connected to a corresponding one of the data lines 220. Further, a drain electrode of the TFT 241 is connected to the pixel electrode 242. The common electrode 243 is generally opposite to the pixel electrode 242, with a plurality of the liquid crystal molecules (not shown) sandwiched therebetween. The common electrode 243, the pixel electrode 242, and the liquid crystal molecules cooperatively form a liquid crystal capacitor 247. The coupling capacitor 245 is connected between the pixel electrode 242 and the corresponding scanning line 210. The storage capacitor 248 is connected between the pixel electrode 242 and the corresponding common line 230. In particular, a capacitance of the coupling capacitor 245 is the same as a sum of capacitances of the corresponding storage capacitor 248 and liquid crystal capacitor 247.

The power supply circuit 206 is configured to provide power voltage to the scanning circuit 202, the data circuit 203, and the common voltage circuit 205. The power supply circuit 206 includes a first power output terminal 261 for outputting a low level power voltage to the scanning circuit 202, a second output terminal 262 for outputting a high level power voltage to the scanning circuit 202, a third power output terminal 263 for outputting a digital power voltage $DV_{CC}$ to the data circuit 203, and a fourth power output terminal 264 for outputting an analog power voltage $AV_{CC}$ to the common voltage circuit 205.

The scanning circuit 202 is configured for providing a plurality of scanning signals to activate the pixel units 240 row by row. The scanning circuit 202 includes a first input terminal 221 for receiving the low level power voltage, a second input terminal for receiving the high level power voltage, a feedback terminal 223 for outputting a feedback signal $V_{FB}$ to the common voltage circuit 205, and a plurality of pulse output terminals 224 for outputting the scanning signals to the scanning lines 210 respectively.

The data circuit 203 is configured for providing a plurality of data voltage signals to the corresponding pixel units 240. The data circuit 203 includes a plurality of data voltage output terminals 232, each of which is connected to a respective one of the data lines 220.

The common voltage circuit 205 is configured for providing common voltage signals for the pixel units 240. The common voltage circuit 205 includes a feedback input terminal 251, a power input terminal 252, a first common voltage output terminal 253, and a second common voltage output terminal 254. The feedback input terminal 251 is configured for receiving the feedback signal $V_{FB}$. The power input terminal 252 is configured for receiving the analog power voltage $AV_{CC}$. The first common voltage output terminal 253 and the second common voltage output terminal 254 are respectively connected to the common lines 230 and the common electrodes 243 of the pixel units 240.

In particular, the common voltage circuit 205 further includes a reference voltage generator 257 and a compensating circuit 258 therein. The reference voltage generator 257 is capable of providing a reference voltage signal $V_{REF}$ to the compensating circuit 258. The compensating circuit 258 is capable of adjusting the reference signal $V_{REF}$ according to the feedback signal $V_{FB}$, so as to generate the common voltage signals.

Figure 2:
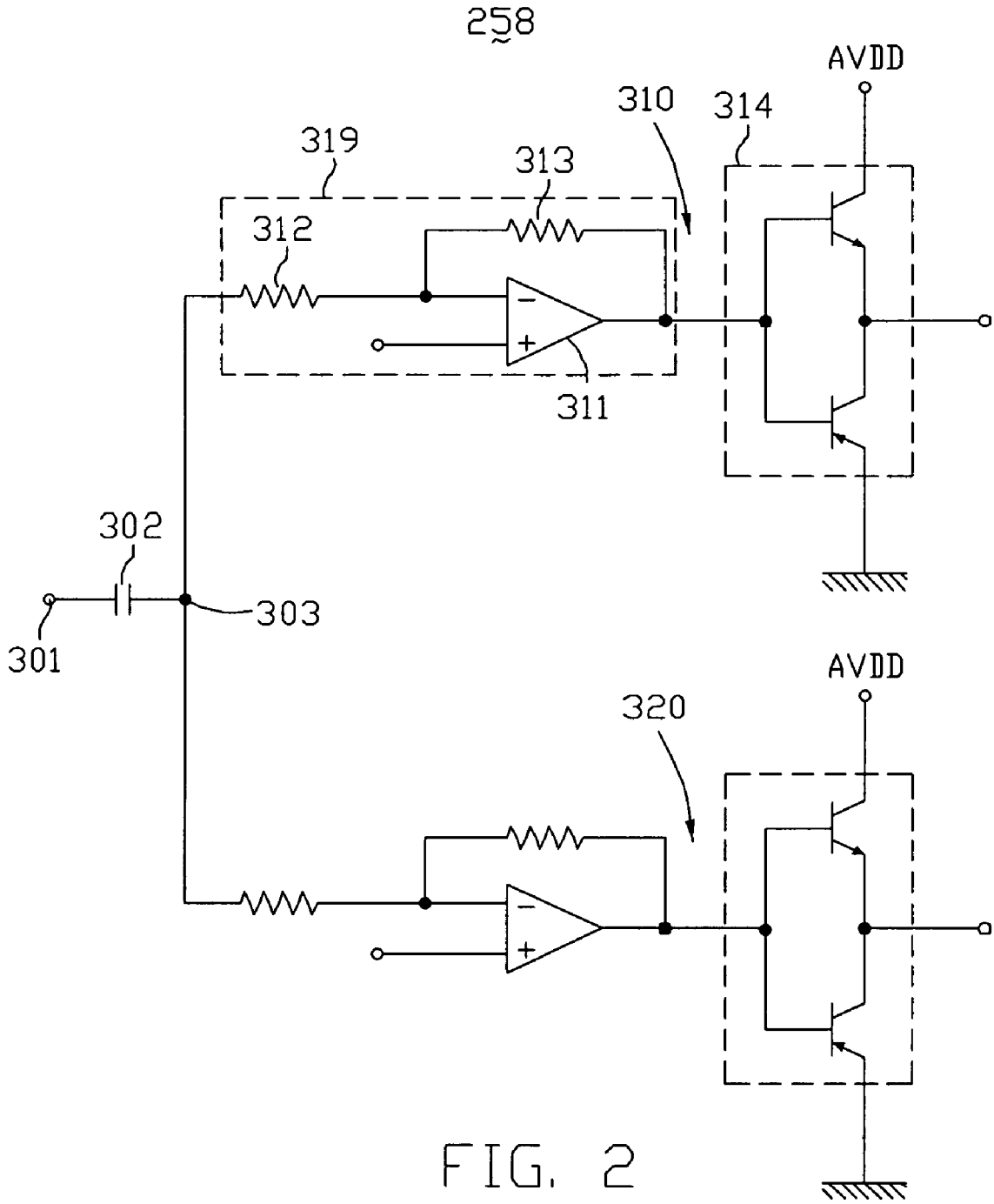
FIG. 2 is a circuit diagram of the compensating circuit of the LCD of FIG. 1.
Figure 3:
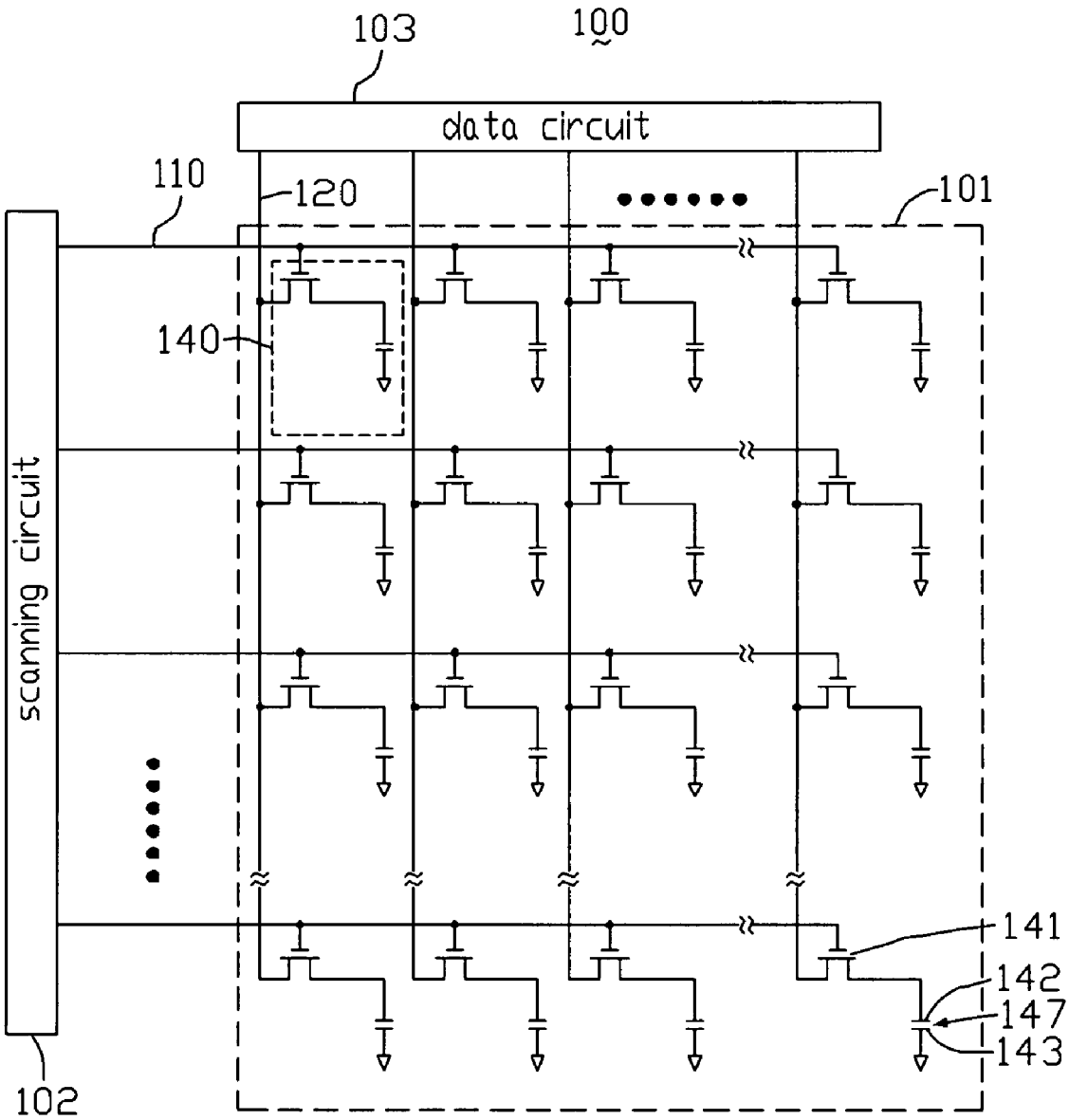
FIG. 3 (RELATED ART)
FIG. 3 is an abbreviated circuit diagram of a conventional LCD.

Referring to FIG. 2, the compensating circuit 258 includes an input terminal 301, a filter capacitor 302, a first compensating branch 310, and a second compensating branch 320. The first compensating branch 310 and the second compensating branch 320 have a common terminal 303. The input terminal 301 is connected to the feedback input terminal 251 of the common voltage circuit 205, such that the feedback signal $V_{FB}$ can be applied to the compensating circuit 258. The filter capacitor 302 is configured as a filter member for filtering a direct current (DC) component from the feedback signal $V_{FB}$, and is connected between the input terminal 301 and the common terminal 303.

Circuit structures of the first compensating branch 310 and the second compensating branch 320 are the same. Each of the first and second compensating branches 310, 320 includes a voltage adjusting circuit 319 and an output circuit 314. The voltage adjusting circuit 319 includes an integrated operational amplifier (IOA) 311 connected in a negative feedback arrangement between the common terminal 303 and the output circuit 314. In particular, an inverting terminal of the IOA 311 is connected to the common terminal 303 via a first resistor 312, and is connected to an output terminal of the IOA 311 via a second resistor 313. A non-inverting terminal of the IOA 311 is configured to receive the reference voltage signal $V_{REF}$ from the reference voltage generator 257. The output circuit 314 employs a so-called complementary circuit, such that an output resistance of the first compensating branch 310 is diminished. Moreover, the output circuits 314 of the first and second compensating branches 310, 320 are respectively connected to the first common voltage output terminal 253 and the second common voltage output terminal 254.

Typical operation of the LCD 200 is as follows.

The power supply circuit 206 provides a low level power voltage and a high level power voltage to the scanning circuit 202, and simultaneously provides a digital power voltage $DV_{CC}$ and an analog power voltage $AV_{CC}$ to the data circuit 203 and the common voltage circuit 205 respectively.

The reference voltage generator 257 generates and outputs a reference voltage signal $V_{REF}$ to the IOAs 311 of the first and second compensating branches 310, 320. The reference voltage signal $V_{REF}$ is treated as a predetermined common voltage signal by each of the IOAs 311, and is transmitted to the corresponding output circuit 314. The predetermined common voltage signal is then outputted to the common lines 230 and the common electrodes 243 of the pixel unit 240.

The scanning circuit 202 provides a plurality of scanning signals, and outputs the scanning signals to the scanning lines 210 sequentially via the pulse output terminals 224. Thereby, the TFTs 241 of the corresponding pixel units 240 are switched on, so as to activate the corresponding pixel units 240. In particular, each of the scanning signals is a pulse signal. A high level voltage of the pulse signal is determined by the high level power voltage, and a low level voltage of the pulse signal is determined by the low level power voltage.

The data circuit 203 provides a plurality of data voltage signals, and outputs the data voltage signals to the pixel electrodes 242 of the corresponding activated pixel units 240 via the data lines 220 and the corresponding TFTs 241. Once the data voltage signal is received by each corresponding pixel electrode 242, due to a capacitor coupling effect, a first interference voltage signal $V_{IF1}$ is correspondingly generated in the common electrode 243 by the liquid crystal capacitor 247 and the storage capacitor 248. Thereby, an electrical potential of the common electrode 243 is coupled and shifts.

The first interference voltage signal $V_{IF1}$ is an alternating current (AC) voltage signal. Assuming that the data voltage signal applied to the pixel electrode 242 of the pixel unit 240 in the current frame period is $V_N$, and a data voltage signal applied to the pixel electrode 242 of the pixel unit 240 in the previous frame period is $V_{N-1}$, a primary value of the first interference voltage signal $V_{IF1}$ can be calculated by the equation $\Delta V=V_N-V_{N-1}$ (i.e. a change of the data voltage signal applied thereto), and the absolute value of the first interference voltage signal $V_{IF1}$ drops gradually in an exponential manner. That is, the first interference voltage signal $V_{IF1}$ can be expressed by the following equation $V_{IF1}=\Delta V*(1-e^{-t/\tau})$, where the symbol t represents a period of time, and the symbol r represents a time constant.

Because all the common electrodes 243 in the activated row of pixel units 240 are connected together, electrical potentials of these common electrodes 243 shift simultaneously. That is, each of the common electrodes 243 has a respective first interference voltage signal $V_{IF1}$ generated therein. All the first interference voltage signals $V_{IF1}$ cooperatively form a first coupling signal $V_{CP1}$. The first coupling signal $V_{CP1}$ superposes the predetermined common voltage signal, such that a first superposing signal is formed in all the common electrodes 243.

Similarly, due to the coupling capacitor 245, a second interference voltage signal $V_{IF2}$ is also generated in the gate electrode of the TFT 241 of the corresponding activated pixel unit 240. Thereby, an electrical potential of the gate electrode of the TFT 241 is also coupled and shifts. Because the second interference voltage signal $V_{IF2}$ also results from the changing of the data voltage signal applied to the pixel unit 240, it is substantially equal to the first interference voltage signal $V_{IF1}$.

Because the pixel units 240 are activated row by row via the corresponding scanning lines 210 in sequence, electrical potentials of the gate electrodes of the TFTs 241 in the activated row of pixel units 240 shift simultaneously. That is, each of the gate electrodes has a respective second interference voltage signal $V_{IF2}$ generated therein. All the second interference voltage signals $V_{IF2}$ cooperatively form a second coupling signal $V_{CP2}$ that is equal to the first coupling signal $V_{CP1}$. The second coupling signal $V_{CP2}$ further superposes the corresponding scanning signal, such that a second superposing signal that is substantially equal to the first superposing signal is formed in the corresponding scanning line 210. The second superposing signal is then sampled by the scanning circuit 202 from the scanning line 210. The sampling signal obtained by the scanning circuit 202 serves as the feedback signal $V_{FB}$, and is outputted to the compensating circuit 258 via the feedback terminal 223.

In the compensating circuit 258, the filter capacitor 302 filters the feedback signal $V_{FB}$, so as to remove the DC component thereof (i.e. the scanning signal). Thereby, the second coupling signal $V_{CP2}$ is extracted from the feedback signal $V_{FB}$, and is then outputted to the first and second compensating branches 310, 320. In the first compensating branch 310, the IOA 311 compares the reference voltage signal $V_{REF}$ with the second coupling signal $V_{CP2}$, and further adjusts the reference voltage signal $V_{REF}$ according to a result of the comparison, so as to generate a first adjusted common voltage signal. The second compensating branch 320 carries out a similar operation simultaneously, and accordingly generates a second adjusted common voltage signal substantially equal to the first adjusted common voltage signal. The first and second adjusted common voltage signals operate to replace the predetermined common voltage signal, and are respectively outputted to the common lines 230 and the common electrodes 243 of the pixel units 240.

The data voltage signals, together with the first adjusted common voltage signal, charge the storage capacitors 248 of the activated row of pixel units 240. In addition, the data voltage signals, together with the second adjusted common voltage signal, charge the corresponding liquid crystal capacitors 247. Thereby, an electric field is generated between the pixel electrode 242 and the common electrode 243 in each pixel unit 240 after the charging process. The electric field drives the liquid crystal molecules of the pixel unit 240 to control the light transmission of the pixel unit 240, such that the pixel unit 240 displays a particular color (e.g., red, green, or blue) having a corresponding gray level. Moreover, the gray level of the color displayed by the pixel unit 240 is maintained by cooperation of the storage capacitor 248 and liquid crystal capacitor 247. The aggregation of colors displayed by all the pixel units 240 simultaneously constitutes an image viewed by a user of the LCD 200.

In summary, in the LCD 200, a plurality of coupling capacitors 245 are provided in the pixel units 240 of the liquid crystal panel 201. Due to the coupling capacitors 245, an electrical potential coupling in the common electrode 243 of each pixel unit 240 is transferred to the gate electrode of the corresponding TFT 241, and the shift of the common voltage signal is transferred to a shift of the scanning signal. The common voltage circuit 205 adjusts the reference voltage signal according to a feedback signal $V_{FB}$ obtained by sampling the scanning signal, such that the shift of the common voltage signal is compensated. Thereby, the electric field between the pixel electrode 342 and the common electrode 343 of each pixel unit 340 is stable during the current frame period. Moreover, because the feedback signal $V_{FB}$ is obtained from the scanning signal that is provided by the scanning circuit 202, the feedback signal $V_{FB}$ is independent of other voltage signals, including the adjusted common voltage signal. By employing such feedback signal $V_{FB}$, the compensation of the common voltage signal is more reliable. Therefore, the gray level of the color displayed by the pixel unit 340 is stable. Accordingly, any color shift phenomenon that might otherwise be induced because of the capacitor coupling effect is diminished or even eliminated, and the display quality of the LCD 200 is improved.

In alternative embodiments, the coupling capacitor 245 in each pixel unit 240 can employ a parasitic capacitor between the gate electrode and drain electrode of the corresponding TFT 241. The compensating circuit 258 can include only one compensating branch, with the single compensating branch outputting an adjusted common voltage signal to the common lines 230 and the common electrodes 243 of the pixel unit 240. The compensating circuit 258 can include three or more compensating branches, with the compensating branches respectively outputting adjusted common voltage signals generated therein to predetermined regions of the pixel units 240 in the liquid crystal panel 201.

It is to be further understood that even though numerous characteristics and advantages of preferred and exemplary embodiments have been set out in the foregoing description, together with details of structures and functions associated with the embodiments, the disclosure is illustrative only; and changes may be made in detail (including in matters of arrangement of parts) within the principles of the invention to the full extent indicated by the broad general meaning of the terms in which the appended claims are expressed.

What is claimed is:

1. A liquid crystal display, comprising:

a liquid crystal panel comprising a plurality of pixel units arranged in rows, a plurality of scanning lines and a plurality of data lines, each pixel unit comprising a thin film transistor, a pixel electrode, and a common electrode, a gate electrode of the thin film transistor connected to a corresponding scanning line, a source electrode of the thin film transistor connected to a corresponding data line, a drain electrode of the thin film transistor connected to the pixel electrode;

a scanning circuit configured to activate the pixel units by outputting a plurality of corresponding scanning signals to the thin film transistors via the scanning lines;

a data circuit configured to provide data voltage signals to the pixel electrodes of the activated pixel units via the corresponding data lines; and a common voltage circuit configured to provide at least one common voltage signal to the common electrodes of the pixel units;

wherein each pixel unit further comprises a coupling member, and when a row of pixel units is activated, all the coupling members in the row of pixel units cooperatively generate a coupling signal according to the data voltage signals applied to the activated row of pixel units, and superpose the coupling signal to the corresponding scanning signal so as to form a feedback signal, the feedback signal is obtained by the scanning circuit sampling the scanning signal from the corresponding scanning line, and is outputted to the common voltage circuit by the scanning circuit, the common voltage circuit adjusts a reference voltage signal according to the feedback signal sampled from the corresponding scanning line, and provides the at least one common voltage signal to the pixel units.

2. The liquid crystal display of claim 1, wherein the coupling member comprises a coupling capacitor.

3. The liquid crystal display of claim 2, wherein the coupling capacitor is a parasitic capacitor of the thin film transistor.

4. The liquid crystal display of claim 1, wherein the common voltage circuit comprises a reference voltage generator configured to provide the reference voltage signal, and a compensating circuit configured to adjust the reference voltage signal.

5. The liquid crystal display of claim 4, wherein the compensating circuit comprises a filter member, and the filter member is configured to extract the coupling signal from the feedback signal.

6. The liquid crystal display of claim 5, wherein the compensating circuit further comprises at least one compensating branch, and the reference voltage signal is adjusted and converted to the at least one common voltage signal via the at least one compensating branch.

7. The liquid crystal display of claim 6, wherein the at least one compensating branch comprises a voltage adjusting circuit and an output circuit, the voltage adjusting circuit converts the reference voltage signal to the at least one common voltage signal, and outputs the at least one common voltage signal to the pixel units via the output circuit.

8. The liquid crystal display of claim 7, wherein the voltage adjusting circuit comprises an integrated operational amplifier, an inverting terminal of the integrated operational amplifier is connected to the filter member via a first resistor, and is connected to an output terminal of the integrated operational amplifier via a second resistor, and a non-inverting terminal of the integrated operational amplifier is configured to receive the reference voltage signal.

9. The liquid crystal display of claim 7, wherein the output circuit is configured to reduce an output resistance of the at least one compensating branch.

10. The liquid crystal display of claim 9, wherein the output circuit is a complementary circuit.

11. The liquid crystal display of claim 6, wherein the at least one compensating branch comprises a first compensating branch and a second compensating branch, and the at least one common voltage signal comprises a first common voltage signal and a second common voltage signal.

12. The liquid crystal display of claim 11, wherein each of the pixel units further comprises a storage capacitor and a liquid c.1stal capacitor, the first compensating branch adjusts the reference voltage signal to provide the first common voltage signal to the storage capacitor, and the second compensating branch adjusts the reference voltage signal to provide the second common voltage signal to the liquid crystal capacitor.

13. The liquid crystal display of claim 12, wherein a capacitance of the coupling member is the same as a sum of capacitances of the corresponding storage capacitor and liquid crystal capacitor.

14. The liquid crystal display of claim 1, wherein an interference signal is generated in each coupling member when the corresponding data voltage signal is applied to the pixel unit, and the coupling signal is generated by the coupling members based on the interference signals thereof.

15. A liquid crystal display, comprising:

a plurality of pixel units arranged in rows and cooperatively defined by a plurality of scanning lines and a plurality of data lines, each pixel unit comprising a thin film transistor, a pixel electrode, and a common electrode, a gate electrode of the thin film transistor connected to a corresponding scanning line, a source electrode of the thin film transistor connected to a corresponding data line, a drain electrode of the thin film transistor connected to the pixel electrode;

a scanning circuit configured to activate the pixel units via the scanning lines;

a data circuit configured to provide data voltage signals to an activated row of the pixel units via the data lines; and a common voltage circuit configured to provide at least one common voltage signal to the common electrodes of the pixel units;

wherein each pixel unit further comprises a coupling member, the coupling members transfer electrical potential shifts of the common electrodes to a corresponding one of the scanning lines when the data voltage signals are applied to the pixel electrodes of the activated row of pixel units, and the common voltage circuit generates at least one common voltage signal according to a feedback signal obtained by the scanning circuit sampling the scanning signal from the corresponding scanning line, and wherein the scanning circuit provides the feedback signal to the common voltage circuit, and the common voltage circuit adjusts the at least one common voltage signal according to the feedback signal.

16. The liquid crystal display of claim 15, wherein the feedback signal is obtained by the scanning circuit sampling a superposing signal of the scanning signal and a coupling signal cooperatively generated by the coupling members according to the data voltage signals.

17. The liquid crystal display of claim 16, wherein the parasitic capacitor is formed between the pixel electrode of the thin film transistor and the scanning line connecting with the gate electrode of the thin film transistor.

18. The liquid crystal display of claim 15, wherein the coupling member comprises a coupling capacitor, and the coupling capacitor is a parasitic capacitor of the thin film transistor.

19. A liquid crystal display, comprising:

a plurality of pixel units arranged in rows and cooperatively defined by a plurality of scanning lines, a plurality of data lines, and a coupling capacitor, each pixel unit comprising a pixel electrode, a common electrode, and a thin film transistor, a gate electrode of the thin film transistor connected to a corresponding scanning line, a source electrode of the thin film transistor connected to a corresponding data line, a drain electrode of the thin film transistor connected to the pixel electrode, the coupling capacitor connected between the pixel electrode and the corresponding scanning line;

a scanning circuit configured to provide scanning signals to corresponding gate electrodes of corresponding thin film transistors via the scanning lines;

a data circuit configured to provide data voltage signals to corresponding source electrodes of corresponding thin film transistors via the data lines; and a common voltage circuit configured to provide at least one common voltage signal to corresponding common electrodes of the pixel units, thereby applying voltages to liquid crystal molecules in corresponding pixel units under control of the scanning signals;

wherein the coupling capacitors transfer electrical potential shifts of the common electrodes to the corresponding scanning lines when the data voltage signals are applied to the corresponding pixel electrodes, the scanning circuit obtains a feedback signal containing electrical potential shifts information from each of the corresponding scanning lines by sampling the scanning signal from each of the corresponding scanning lines, the scanning circuit provides the feedback signal to the common voltage circuit, and the common voltage circuit adjusts the at least one common voltage signal according to the feedback signal.

20. The liquid crystal display of claim 19, wherein the common voltage circuit comprises a reference voltage generator configured to provide the reference voltage signal, and a compensating circuit configured to adjust the reference voltage signal, the compensating circuit comprises a filter member, and the filter member is configured to extract the electrical potential shifts information from the feedback signal.

* * * * *